US008505348B2

(12) United States Patent
Colasse

(10) Patent No.: US 8,505,348 B2
(45) Date of Patent: Aug. 13, 2013

(54) KEY WITH SPRING-LOADED WINDOW BREAKER

(76) Inventor: Laurent Colasse, Santa Barbara, CA (US)

( * ) Notice: Subject to any disclaimer, the term of this patent is extended or adjusted under 35 U.S.C. 154(b) by 0 days.

(21) Appl. No.: 13/339,273

(22) Filed: Dec. 28, 2011

(65) Prior Publication Data

US 2013/0167601 A1 Jul. 4, 2013

(51) Int. Cl.
*E05B 19/00* (2006.01)

(52) U.S. Cl.
USPC ..... 70/395; 70/456 R; 70/408; 206/234; D8/347; D3/207; 340/574

(58) Field of Classification Search
USPC ..... 70/456 R–458, 393, 395, 397, 400, 70/408; D3/207–212; D8/347, 348; 206/234; 340/574
See application file for complete search history.

(56) References Cited

U.S. PATENT DOCUMENTS

| | | | | |
|---|---|---|---|---|
| 1,574,497 | A | 2/1926 | McLean | |
| 2,136,199 | A | 11/1938 | Swanson | |
| 2,547,816 | A * | 4/1951 | Duncan | 362/116 |
| 2,630,212 | A * | 3/1953 | Mosch | 132/317 |
| 2,745,244 | A | 5/1956 | Friedli | |
| 2,982,454 | A | 5/1961 | Wolberg | |
| 4,726,205 | A | 2/1988 | Allerdist | |
| 4,787,016 | A | 11/1988 | Song | |
| 5,621,936 | A | 4/1997 | Penaligon | |
| 5,657,543 | A | 8/1997 | Collins | |
| 5,819,568 | A | 10/1998 | Christie | |
| D400,779 | S | 11/1998 | Chen | |
| D442,466 | S | 5/2001 | Van Den Acker | |
| 6,223,441 | B1 | 5/2001 | Parsons | |
| 6,418,628 | B1 * | 7/2002 | Steingass | 30/367 |
| D575,182 | S * | 8/2008 | Rubin et al. | D10/104.1 |
| 7,557,720 | B2 * | 7/2009 | Rubin et al. | 340/574 |
| 8,146,192 | B2 * | 4/2012 | McGlynn | 7/158 |

* cited by examiner

*Primary Examiner* — Suzanne Barrett
(74) *Attorney, Agent, or Firm* — Guy Cumberbatch

(57) ABSTRACT

A multipurpose key for use by vehicle operators in the case of emergency. In addition to conventional key electronics, the key including a glass-breaking spike, an open slot cutter for cutting seat belts and the like, and may also include a light, an alarm, and other functions. The multipurpose key is formed as a single key unit so as to be always available in the ignition slot of the vehicle in case of emergency. A key portion may be separable from the glass-breaking spike portion.

20 Claims, 2 Drawing Sheets

KEY WITH SPRING-LOADED WINDOW BREAKER

FIELD OF THE INVENTION

The present invention is directed to an emergency glass breaking device, and more particularly to a spring-loaded emergency glass breaking device that is easy and safe to use, and is conveniently incorporated into a vehicle key.

BACKGROUND OF THE INVENTION

Glass breaking devices can be used in emergencies to gain access to or provide escape from an automobile or building. Specialized glass-breaking devices typically include a handle and a spike. The handle is swung like a hammer to impact the spike on a pane of glass to be broken. The spike is made of steel and is pointed to maximize the breaking power of the device.

Most glass breaking devices are available to emergency personnel such as firefighters, police, and emergency medical technicians. Some of these devices are combined with other tools that are likely to be used by emergency personnel. For example, the Res-Q-Rench® available from Task Force Tips, Inc. of Valparaiso, Ind. includes a glass-breaking spike, a spanner wrench, a pry tool, a gas main wrench slot, and a seat belt cutter for extricating automobile passengers who are unable to remove their seat belts. Such devices are convenient and work extremely well, but they are not typically available to the general public.

Another device that is available to the general public is the ResQMe™ sold by nov8 of Santa Barbara, Calif. The ResQMe™ auto safety device includes a glass-breaking spike and a seat belt cutting razor incorporated into a unit having an eyelet that can be attached to a key ring. A similar design is seen in WO/2002076554 to Steingass, et al. Unfortunately, though the device is relatively small, it is somewhat larger than many people prefer to put on their key ring. Therefore, the ResQMe™ auto safety device is typically placed in a receptacle or door pocket close to the driver. In an emergency, the device may be difficult to find, especially if other items have been placed on top of and buried it.

Thus, there is a need for a glass breaking device that is effective and more easily accessible to the driver in an emergency.

SUMMARY OF THE INVENTION

The present invention addresses the above-described problems by providing a multipurpose key that can be used to break through vehicle glass or cut through seatbelts in an emergency. By providing the emergency functions on the key itself, they are always available to the driver or passenger(s).

A multipurpose key for use by vehicle operators in the case of emergency. In addition to conventional key electronics, the key including a glass-breaking spike and an open slot cutter for cutting seat belts and the like. Optionally, the key may also include a light, an alarm, and other safety-related functions. A key portion may be separable from the glass-breaking spike portion to provide further flexibility.

In accordance with one aspect, a multipurpose key comprises a vehicle key extending from a key housing, and a glass-breaking portion within a housing including a spring-loaded spike for breaking vehicular glass. The key housing and the housing of the glass-breaking portion are rigidly connected so as to form a single key unit. The combined vehicle key and its key housing and the glass-breaking portion within its housing form a single key unit having dimensions of: a length of between about 2-3 inches (5-8 cm), a width of between about 1-1.5 inches (2.5-3.3 cm), and a thickness of between about 0.375-0.75 inches (0.9-1.9 cm). In one embodiment, the glass breaking portion and its housing are separable from the vehicle key and its key housing such as with a tongue and groove arrangement which can be slid apart.

In a second embodiment a multipurpose key comprise a vehicle key extending from a key housing, and a glass-breaking portion within a housing including a spring-loaded spike for breaking vehicular glass. The key housing and the housing of the glass-breaking portion are rigidly connected in a primary configuration so as to form a single key unit, wherein the glass breaking portion and its housing are selectively separable from the vehicle key and its key housing. The glass breaking portion housing and the key housing are coupled together with a tongue and groove arrangement which can be slid apart.

The separable or non-separable multipurpose key may further include a seat belt cutting portion and a corresponding housing, wherein the key housing, the housing of the glass-breaking portion and the housing of the seat belt cutting portion are rigidly connected so as to form a single key unit. The housing of the glass-breaking portion may be sandwiched between the housing of the seat belt cutting portion and the key housing, or alternatively the housing of the seat-belt cutting portion is sandwiched between the housing of the glass-breaking portion and the key housing. Desirably, the seatbelt cutting portion comprises a slot with an angled razor edge therein, and further includes a protective tab that mates with the slot to cover the razor edge. The glass-breaking portion further may have a light on one end, and the multipurpose key has an on-off switch for the light. If the glass breaking portion and its housing are separable from the vehicle key and its key housing, the light switch is on the housing of the glass-breaking portion.

A further understanding of the nature and advantages of the invention will become apparent by reference to the remaining portions of the specification and drawings.

BRIEF DESCRIPTION OF THE DRAWINGS

Features and advantages of the present invention will become appreciated as the same become better understood with reference to the specification, claims, and appended drawings wherein:

DETAILED DESCRIPTION OF THE PREFERRED EMBODIMENTS

The present invention is directed to an improved emergency tool incorporated into a multipurpose vehicle key having a glass-breaking spike and seat belt cutting razor therein. The glass-breaking spike is sufficiently robust to break through most tempered vehicle window glass, although such devices are typically more effective in breaking side windows rather than windshields. Of course, those of skill in the art will understand that the strength of the glass-breaking spike can be increased to break windshields too.

Figure 1:
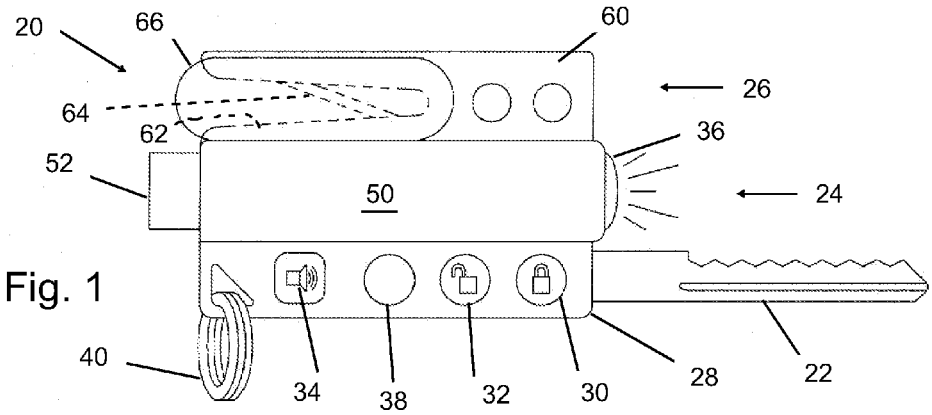
FIG. 1 is a side elevational view of a non-separable embodiment of a multipurpose key of the present application.

FIG. 1 illustrates a first embodiment of a multipurpose key 20 of the present application that includes a vehicle key 22, a glass-breaking portion 24, and a seat belt cutting portion 26. In this embodiment, the key 22 extends from a longitudinally-oriented housing 28 adjacent to the glass-breaking portion 24, with the seat belt cutting portion 26 arranged on the opposite side thereof. That is, the longitudinally-oriented housing 28 and seat belt cutting portion 26 sandwich the glass-breaking portion 24 therebetween.

The multipurpose key 20 includes conventional key features such as lock 30 and unlock 32 buttons, and an alarm button 34. Internal circuitry (not shown) including a radio-frequency transmitter enable the driver to unlock and lock the vehicle door from a distance, and to set off a car alarm with the button 34. In addition, a light 36 actuated by a switch 38 may be provided. Again, the internal battery and circuitry components are conventional and will not be shown. The key 20 further may include a small ring 40 enabling attachment of other accoutrements or secondary keys typically found on vehicular key rings.

The visible part of the glass-breaking portion 24 includes a longitudinally-oriented outer housing 50 and a distal end of a safety sheath 52 that moves longitudinally within the housing. The glass-breaking function is activated by pressing the visible portion of the safety sheath 52 against glass until an internal spring causes a spike to project through a hole (not shown) on the left side of the safety sheath 52. The functional components of an exemplary glass-breaking portion 24 will be described below with respect to FIGS. 4A to 4D.

The seatbelt cutting portion 26 includes a molded housing part 60 that defines a longitudinally-oriented tapered slot 62 opening to the left side. A razor edge 64 mounts across the slot 62 at an angle and recessed from the open end of the slot. The razor edge 64 is sufficiently sharp and positioned at an optimum angle such that it may easily cut through seatbelts that are fed into the slot 62. A protective tab 66 mates with the slot 62 to cover the razor edge 64 when not in use. Preferably, the tab 66 includes a detente feature that permits it to be snapped in position over the slot 62, and easily pulled off when a person needs to utilize the razor edge 64.

The multipurpose key 20 has a non-separable construction whereby the longitudinally-oriented housing 28, glass-breaking portion 24, and seat belt cutting portion 26 are fixed together. The housings of each of these three elements may be molded as a single part, or they may be molded separately and affixed together during manufacture, such as with a suitable adhesive. More likely, the three housings may be formed in two similar halves which are adhered or otherwise bonded together along a central plane. The key housing 28 and the housings of the glass-breaking portion 24 and seat belt cutting portion 26 are therefore rigidly connected so that the combined housings and their functional elements form a single key unit. A single key unit in this sense means a unit that can easily be pocketed as a unitary object like a standard vehicle key. There are no relatively moving parts; like a key having a keyring with other keys and/or objects attached. The entire single key unit has a length of between about 2-3 inches (5-8 cm), a width of between about 1-1.5 inches (2.5-3.3 cm), and a thickness of between about 0.375-0.75 inches (0.9-1.9 cm). There may be numerous permutations of shapes depending on the vehicle maker, but the important thing is the single multipurpose key unit is a rigid unitary object that mimics a standard vehicle key.

Figure 2:
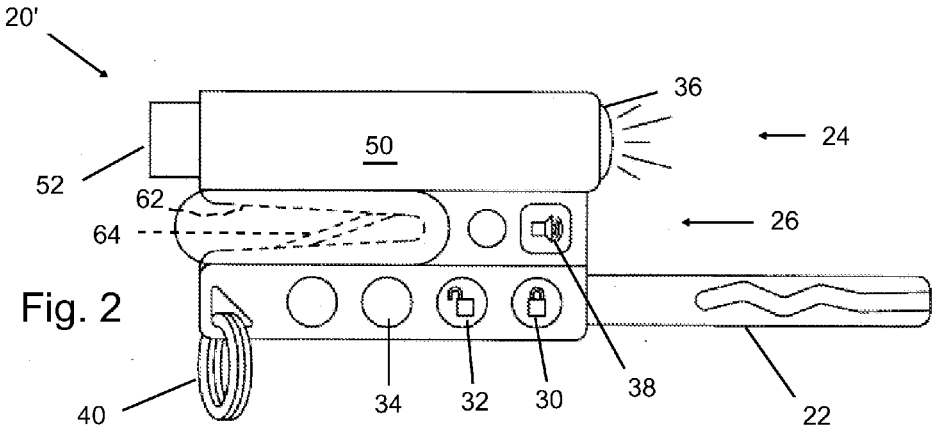
FIG. 2 is a side elevational view of a second embodiment of a non-separable multipurpose key of the present application.

FIG. 2 shows a different non-separable multipurpose key 20' that is very similar to the key 20 described above, and as such common features will be given the same numbers as in FIG. 1. The actual working end of the key portion 22 in the key 20' is of a different type (grooves on both sides rather than a cut edge), but the primarily difference is that the stacked positions of the glass-breaking portion 24 and seat belt cutting portion 26 have been reversed. This places the safety sheath 52 in a somewhat more accessible position for pressing against and ultimately causing glass to break when the spike springs out.

Figures 3A, 3B:
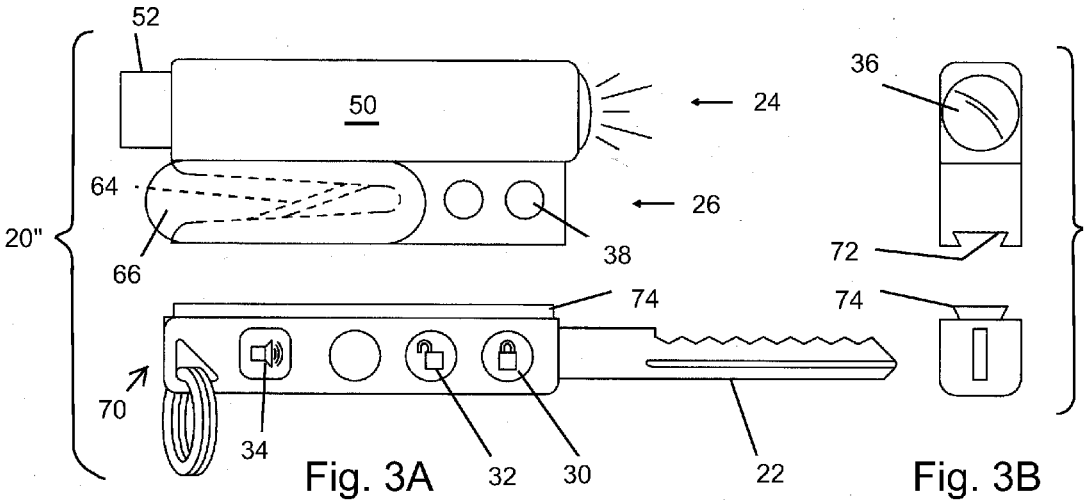
FIG. 3A is an exploded side elevational view of a separable multipurpose key embodiment similar to that shown in FIG. 2.
FIG. 3B is an exploded end view of the separable multipurpose key of FIG. 3A.

FIGS. 3A and 3B illustrate a still further multipurpose key 20" that is much like the second embodiment shown in FIG. 2, but the combined glass-breaking portion 24 and seat belt cutting portion 26 is separable from a key portion 70. More particularly, the illustrated embodiment shows a female groove 72 on the seatbelt cutting portion 26 that receives a trapezoidal tongue 74 on the key portion 70. A detent arrangement (not shown) may be included to ensure the groove 72 slides over to a particular position along the tongue 74 and clicks into place. This arrangement provides a single key unit while also permitting the emergency functions of the multipurpose key 20" to be temporarily separated from the key functions. The ability to separate the emergency functions from the key functions is advantageous if the owner desires to carry just the slim key portion, for example. The key portion 70 retains the key control buttons 30, 32 and 34, and accompanying electronics, so as to be autonomously used to open, close and start a vehicle. In one embodiment, the switch 38 for the light 36 remains on the seat belt cutting portion 26. At the same time, the ordinarily combined emergency and key functions permit the owner to carry around a single multipurpose key 20" unit which will always be ready in the ignition of the vehicle in case of emergency.

Though a tongue and groove coupling is shown for the separable emergency and key portions of the multipurpose key 20" of FIGS. 3A and 3B, other configurations for detachably coupling the two are contemplated. For instance, the shape of the tongue and groove may be altered, so as to resemble a T-member in a similarly-shaped slot, for example. Another possibility is to couple the two elements using a magnet, or a magnet and slot and groove assembly. Still further, the two elements may be nominally secured together with a breakaway connection that can be separated in an emergency but otherwise remains together. Finally, an easily accessed button or lever may be included to selectively release the combined glass-breaking portion 24 and seat belt cutting portion 26 from the key portion 70. It should be emphasized that the glass-breaking portion 24 of the multipurpose key 20" can be used while still coupled to the key portion 70 or as a separate unit. The protective tab 66 concealing the razor 64 is easily removed in either configuration to enable the seatbelt cutting function.

The present application also contemplates alternative multipurpose keys, such as key switches and key fobs which are essentially keyless entry devices. For instance, an alternative to the multipurpose key 20 of FIG. 1 could include the glass-breaking portion 24 and the seat belt cutting portion 26 incorporated into the housing 28, but a shorter electronic probe rather than the longitudinally-projecting vehicle key 22. Also, the vehicle key 22 can be done away with altogether to form a key fob where the housing 28 includes electronics that permit remote entry to a vehicle door or ignition. Newer so-called "Advanced Keys" may also be fitted with the multipurpose tools described herein. Such keys are used with cars that have a proximity system that is triggered if a keylike transducer (Advanced Key) is within a certain distance of the car. Sometimes called hands-free, these systems are commonly found on imported vehicles, such as Infiniti, Mitsubishi, Mercedes-Benz, Audi, Subaru, BMW, Toyota, Volvo, Lexus, Nissan and Hyundai—for instance, the "smart key" of a newer Toyota Prius. With the Advanced Key system, a vehicle can be unlocked without the driver needing to physically push a button on the key fob to lock or unlock the car and is also able to start or stop the ignition without physically having to insert the key and turning the ignition. Instead, as you approach the vehicle, the vehicle senses that the key (located in a pocket, purse, etc.) is approaching the vehicle. In short, any access device that is normally used to open a vehicle door and/or start the ignition, and which typically remains handy next to the driver in the vehicle, either in the dashboard/console or in a purse, may include the multiple tools as described herein and be termed a multipurpose key. In each of these devices there will be an access tool such as a physical (metallic) or electronic key to open the door or start the vehicle. As such, the term "vehicle key" is used herein to encompass all of these alternative structures.

Referring to FIGS. 4A to 4D, the inner workings of the glass-breaking portion 24 of the tool 20, 20', or 20" will be described in four of its primary operating positions. Certain element numbers will be used from the embodiment FIG. 1 for context. The right end of the glass-breaking portion 24 is cut away, and will incorporate electronics and/or a battery (not shown) for the multipurpose key 20.

In each of the figures, the glass-breaking portion 24 can be seen as including: the housing 50, the safety sheath 52, a glass breaking spike 106, a spike shaft 114, a spike shaft collar 112, a safety sheath spring 132, and a spike shaft spring 134. All of the components of this preferred embodiment are symmetrical about and move parallel to a longitudinal axis (horizontal in the drawings) with the exception of the spike 106 and spike spring 134 which are oriented at an angle for functional reasons as described below.

The glass-breaking portion 24 includes the safety sheath 52 that is in a shape that essentially matches the housing 50 shape so that the two can move relative to one another with ease. In the illustrated example, the safety sheath 52 is cylindrical and coaxial with the cylindrical housing 50. The housing 50 and the safety sheath 52 both move longitudinally during operation of the glass-breaking portion 24.

The purpose of the safety sheath 52 is to shield a glass breaking spike 106 when not in use so that the spike 106 does not snag or puncture the user, pockets, purses, or anything else that may come into contact with the spike 106. The safety sheath 52 also serves to cock the glass breaking spike 106 as the tool 20 is pressed against the glass. The safety sheath 52 is the only portion of the tool 20 intended to make contact with the glass prior to the spike 106.

Further, the exposed end of the safety sheath 52 is preferably closed except for an opening 108 large enough that the spike 106 can extend through it when breaking glass. The opening 108 is eccentric with respect to the tool 20 or the safety sheath 52 so that it matches the eccentric travel path of the spike 106, as described below. The end of the safety sheath 52 preferably includes ridged embossments 110 that help tolerate slight variations from perpendicular alignment when it is pushed against glass. The embossments also provide a way for water to escape inside of the tool 20 and the impact area when the tool 20 is operated underwater. It is important to provide for this escape of water to avoid the risk that the spike 106 could be slowed down excessively when operated under water.

The geometry of the tip of the spike 106 should not be too blunt or too sharp. If too blunt, the spike 106 will not be able to cause enough stress in the glass to cause breakage. If too sharp, the spike 106 may not be durable enough to withstand impact with the glass, thereby blunting the spike.

Preferably, the spike 106 has a conical tip with a 90° cone angle. The tip of the conical portion of the spike is preferably a flat area with a 0.003-0.007 inch (0.076-0.178 mm) diameter. The spike 106 should be of sufficient hardness to retain proper tip geometry when impacting glass, such as 01 drill rod, heat treated to a Rockwell hardness of 60-65 on the C-scale.

Alternatively, a carbide ball of 0.04 inch (1 mm) in diameter (such as used in ball point pens) could be press-fit into the end of an unheated treated spike body. This arrangement would have a high degree of hardness and an extremely consistent geometry.

The spike 106 includes the collar 112 affixed to the shaft 114. The spike 106 and collar 112 can be threaded together, snap-fit together, or secured with a suitable adhesive, and can be permanently attached or be replaceable. In one embodiment, there is a snap-fit between a ⅛ inch (3.2 mm) diameter spike shaft 114 and a plastic collar 112 to form the spike 106.

The spike shaft 114 has a reduced-diameter section that defines a shoulder 116 that limits the rearward travel of the spike 106 as the tool 20 is being cocked. The shoulder 116 engages a housing bore 118 when the tool 20 is in the cocked position and just prior to release.

Figure 4A:
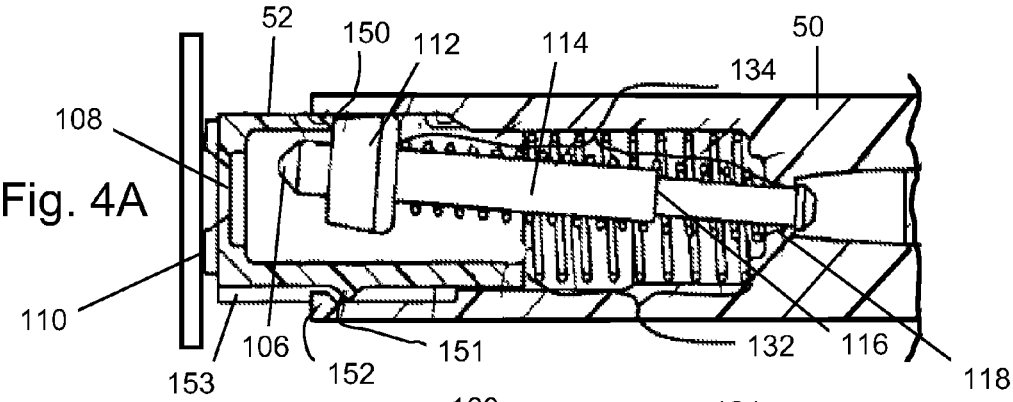
FIGS. 4A-4D illustrate the workings of an inner class-breaking spike incorporated into the multipurpose keys of the present application.
Figure 4B:
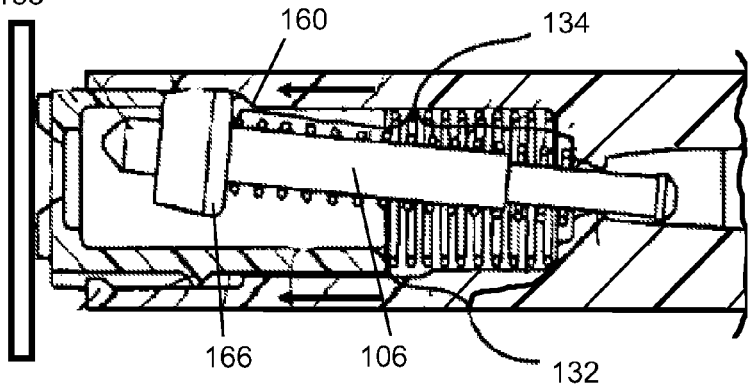
Figure 4C:
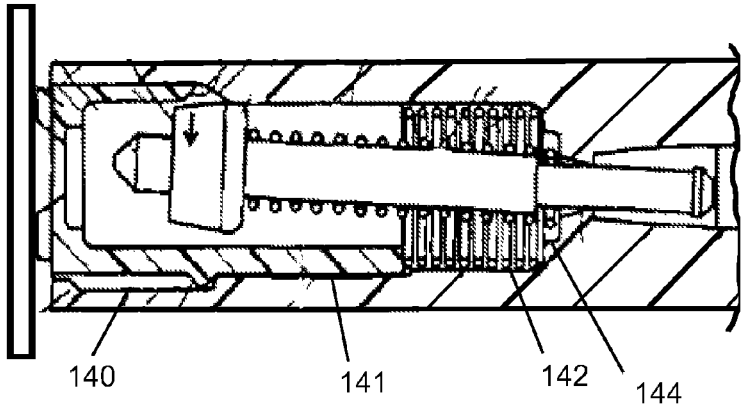

The cross-sectional views, such as FIG. 4C, illustrate that the housing 50 has three internal diameters, a large internal diameter 140, an intermediate internal diameter 141, and a small internal diameter 142. The large 140 and intermediate 141 internal diameter portions accommodate movement of the safety sheath 52, while the small internal diameter 142 portion accommodates the right end of the spike 106. In addition, the intermediate internal diameter portion 141 houses the safety sheath compression spring 132 which biases the safety sheath 52 outwardly (to the left, as viewed) from the housing 50. A step 144 at the left end of the small diameter 142 housing portion serves as a bearing surface for the safety sheath spring 132 to bias the spike 106 outwardly (to the left as shown).

The interior of the safety sheath 52 is generally cylindrical and, as described above, is closed at its end to provide a stop for preventing the spike shaft 114 from being forced out of the housing 50 when the glass-breaking portion 24 is operated.

The housing 50 has integral tongues 152 that mate with grooves 153 in the safety sheath 52 to permit coaxial movement, but prevent relative rotation of these two parts. A tab 151 and a tongue 152 interact to form a snap that retains the safety sheath 52 in the housing 50 with a snap-fit.

The safety sheath 52 has a portion removed (on the top, as viewed) to define a shoulder 150 on which the collar 112 bears when in the positions depicted in FIGS. 4A, 4B, and 4C. In this manner, the safety sheath 52 can be pushed against glass to force the spike 106 inward against the force of springs 132 and 134 (FIG. 4B).

The spike collar 112 has a collar ramp 166 on its inner edge. The spike collar ramp 166 interacts with a housing ramp 160 during operation.

As described above, the spike 52 is typically maintained in a position that is slightly out of coaxial alignment with the other elements of the glass-breaking portion 24 (see FIGS. 4A and 4B). The spike 106 is biased toward this position by spike spring 134, but it is realigned against the force of the spike spring 134 when the spike shaft ramp 166 is engaged by the housing ramp 160 during operation. This engagement of the ramps shifts the orientation of the spike 106 to a more coaxial alignment with the other components. When this occurs, the spike ramp 166 and the housing ramp 160 disengage and the spike spring 134 is able to quickly urge the spike 106 toward the glass for impact.

Figure 4D:
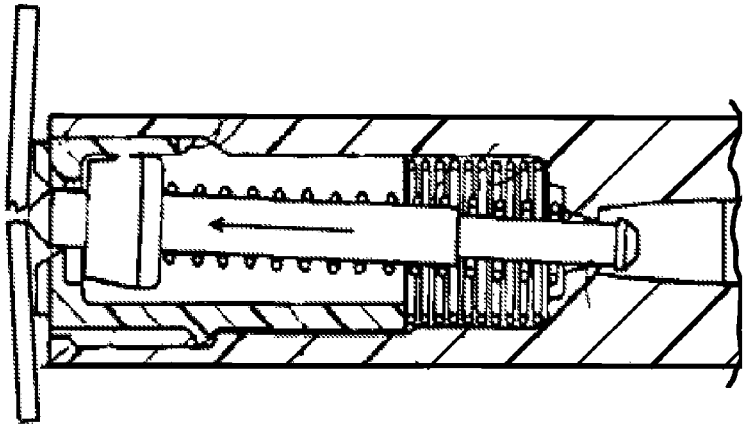

During operation, the glass-breaking portion 24 proceeds through essentially four primary operating positions: the ready position (FIG. 4A); the cocked position (FIG. 4B); the fire position (FIG. 4C); and the break position (FIG. 4D).

In the ready position, the safety sheath 52 has its ridged embossments 110 placed against the glass, the spike 106 is near its outermost position (left-most) relative to the housing 50, and the collar 112 affixed to the shaft 114 of the glass breaking spike 106 is resting against the shoulder 150 of the safety sheath 52.

Also in the ready position (FIG. 4A), the safety sheath spring 132 is slightly compressed and is biasing the safety sheath 52 outward to shield the spike 106 from inadvertent damage to people and property. The spike spring 134 is biasing the spike 106 out of coaxial alignment with axis to engage the safety sheath shoulder 150.

In the cocked position (FIG. 4B), a user (not illustrated) has exerted finger pressure against the outer surface of the housing 50 to move the housing 50 toward the glass. The distance moved toward the glass is not the complete length to be traveled by the housing 50 and sheath 52, but in a preferred embodiment, it is about 60% of the entire travel distance. In a most preferred embodiment, the distance traveled by the housing 50 between the ready position (FIG. 4A) and the cocked position (FIG. 4B), is about ⅛ of an inch (3 mm).

Also in response to the user pressing on the housing's outer surface, the safety sheath spring 132 is compressed so that the safety sheath 52 can remain in contact with the glass, but also slide into the housing 50, as illustrated.

The spike 106 has been moved inward (to the right) relative to the housing 50 by the shoulder 150 on the safety sheath 52, but the spike shaft ramp 166 has not engaged (in any appreciable amount) the housing ramp 160.

In the fire position (FIG. 4C), the user has pushed the housing 50 its entire distance of travel toward the pane of glass. Preferably, the distance between the housing in the cocked position and the fire position is about 40% of the total distance traveled by the housing 50 during operation. In a most preferred embodiment, that distance is about 3/32 of an inch (2.5 mm), while the total distance from ready (FIG. 4A) to fire (FIG. 4B) is 39 inches.

When the housing 50 has been moved to the fire position (FIG. 4C), the safety sheath 52 is still compressing the safety sheath spring 134.

During the additional movement the housing 50 has forced the housing ramp 160 into contact with the spike ramp 166. The engagement of the housing ramp 160 and the spike ramp 166 realigns the spike 106 toward the axis against the bias of the spike shaft spring 134, which in turn disengages the spike 106 from the housing ramp 160. When disengaged, the spike spring 136 is no longer compressed and will, in an instant, expand to move the spike 106 outwardly (to the left as viewed). In the illustrated embodiment, the estimated velocity of the spike at impact is 40 feet/second in air or at a slightly slower velocity (about 90% of the total velocity will be retained) when operated under water.

The result of the spike spring 136 expanding is that the spike 106 impacts and breaks the glass (FIG. 4D). In this position, the housing 50 is still at its greatest distance traveled, the safety sheath 52 is still in contact with the glass to shield the user from flying glass, and the glass breaking spike 106 impacts the glass for only a small distance, but enough to shatter the glass. This allows the spike 106 to break glass, but not severely injure a person if the tool 20 were operated against skin. The device is intended to shatter tempered glass, but in the illustrated embodiment, it will not shatter laminated glass.

All of the above-described movements can take place as a result of a single pushing movement by the user, and they all occur in a short time. Thus, the glass-breaking portion 24 is useful in emergencies and can be used with little thought as to its operation.

Suitable materials for the glass breaker components include, but are not limited to: housing (plastic such as nylon); safety sheath (low strength impact resistant plastic such as polyethylene); spike shaft (metal such as carbon steel); sleeve (High Impact plastic such as nylon, or lightweight metal such as aluminum); spike shaft collar (preferably a standard retaining ring made from spring steel); hammer (low carbon steel); and springs (music wire).

Although the invention has been described and illustrated with a certain degree of particularity, it is understood that the present disclosure has been made only by way of example, and that numerous changes in the combination and arrangement of parts can be resorted to by those skilled in the art without departing from the scope of the invention, as hereinafter claimed.

What is claimed is:

1. A multipurpose key, comprising:

a vehicle key rigidly fixed within a key housing; and a glass-breaking portion within a housing including a spring-loaded spike for breaking vehicular glass, wherein the key housing and the housing of the glass-breaking portion are rigidly fixed with respect to one another so as to form a single unitary object key unit, wherein the combined vehicle key and its key housing and the glass-breaking portion within its housing form a single unitary key unit having dimensions of: a length of between about 2-3 inches (5-8 cm), a width of between about 1-1.5 inches (2.5-3.3 cm), and a thickness of between about 0.375-0.75 inches (0.9-1.9 cm).

2. The multipurpose key of claim 1, wherein the glass breaking portion and its housing are separable from the vehicle key and its key housing.

3. The multipurpose key of claim 2, wherein the glass breaking portion housing and the key housing are coupled together with a tongue and groove arrangement which can be slid apart.

4. The multipurpose key of claim 1, further including a seat belt cutting portion and a corresponding housing, wherein the key housing, the housing of the glass-breaking portion and the housing of the seat belt cutting portion are rigidly connected so as to form a single key unit.

5. The multipurpose key of claim 4, wherein the housing of the glass-breaking portion is sandwiched between the housing of the seat belt cutting portion and the key housing.

6. The multipurpose key of claim 4, wherein the housing of the seatbelt cutting portion is sandwiched between the housing of the glass-breaking portion and the key housing.

7. The multipurpose key of claim 4, wherein the seatbelt cutting portion comprises a slot with an angled razor edge therein, and further includes a protective tab that mates with the slot to cover the razor edge.

8. The multipurpose key of claim 1, wherein the glass-breaking portion further includes a light on one end, and the multipurpose key has an on-off switch for the light.

9. The multipurpose key of claim 8, wherein the glass breaking portion and its housing are separable from the vehicle key and its key housing, and the light switch is on the housing of the glass-breaking portion.

10. The multipurpose key of claim 1, wherein the vehicle key is a physical metallic key extending from the key housing.

11. A multipurpose key, comprising:

a vehicle key rigidly fixed within a key housing; and a glass-breaking portion within a housing including a spring-loaded spike for breaking vehicular glass, wherein the key housing and the housing of the glass-breaking portion are rigidly fixed with respect to one another in a primary configuration so as to form a single unitary object key unit, and wherein the glass breaking portion and its housing are selectively separable from the vehicle key and its key housing.

12. The multipurpose key of claim 11, wherein the glass breaking portion housing and the key housing are coupled together with a tongue and groove arrangement which can be slid apart.

13. The multipurpose key of claim 11, further including a seat belt cutting portion and a corresponding housing, wherein the key housing, the housing of the glass-breaking portion and the housing of the seat belt cutting portion are rigidly connected so as to form a single key unit.

14. The multipurpose key of claim 13, wherein the housing of the glass-breaking portion is sandwiched between the housing of the seat belt cutting portion and the key housing.

15. The multipurpose key of claim 13, wherein the housing of the seatbelt cutting portion is sandwiched between the housing of the glass-breaking portion and the key housing.

16. The multipurpose key of claim 13, wherein the seatbelt cutting portion comprises a slot with an angled razor edge therein, and further includes a protective tab that mates with the slot to cover the razor edge.

17. The multipurpose key of claim 11, wherein the glass-breaking portion further includes a light on one end, and the multipurpose key has an on-off switch for the light.

18. The multipurpose key of claim 17, wherein the glass breaking portion and its housing are separable from the vehicle key and its key housing, and the light switch is on the housing of the glass-breaking portion.

19. The multipurpose key of claim 11, wherein the combined vehicle key and its key housing and the glass-breaking portion within its housing form a single key unit having dimensions of: a length of between about 2-3 inches (5-8 cm), a width of between about 1-1.5 inches (2.5-3.3 cm), and a thickness of between about 0.375-0.75 inches (0.9-1.9 cm).

20. The multipurpose key of claim 11, wherein the vehicle key is a physical metallic key extending from the key housing.

* * * * *